US006563415B2

(12) United States Patent
Armstrong

(10) Patent No.: US 6,563,415 B2
(45) **Date of Patent: *May 13, 2003**

(54) ANALOG SENSOR(S) WITH SNAP-THROUGH TACTILE FEEDBACK

(76) Inventor: Brad A. Armstrong, P.O. Box 2048, Carson City, NV (US) 89702

( * ) Notice: Subject to any disclaimer, the term of this patent is extended or adjusted under 35 U.S.C. 154(b) by 0 days.

This patent is subject to a terminal disclaimer.

(21) Appl. No.: 09/955,838

(22) Filed: Sep. 18, 2001

(65) Prior Publication Data

US 2002/0067241 A1 Jun. 6, 2002

Related U.S. Application Data

(60) Division of application No. 09/455,521, filed on Dec. 7, 1999, now abandoned, which is a continuation of application No. 09/106,825, filed on Jun. 29, 1998, now Pat. No. 5,999,084, and a continuation-in-part of application No. 08/677,378, filed on Jul. 5, 1996, now Pat. No. 6,222,525.

(51) Int. Cl.[7] ..... H01C 10/10

(52) U.S. Cl. ..... 338/47; 338/5; 338/99; 338/112; 338/114

(58) Field of Search ..... 338/43, 46, 2, 338/5, 4, 47, 92, 99, 112, 114

(56) References Cited

U.S. PATENT DOCUMENTS

| | | | |
|---|---|---|---|
| 3,611,068 | A | 10/1971 | Fujita |
| 3,771,037 | A | 11/1973 | Bailey |
| 3,806,471 | A | 4/1974 | Mitchell |
| 3,952,173 | A | 4/1976 | Tsuji |
| 3,988,556 | A | 10/1976 | Hyodo |
| 4,224,602 | A | 9/1980 | Anderson |
| 4,268,815 | A | 5/1981 | Eventoff |
| 4,276,538 | A | 6/1981 | Eventoff |
| 4,301,337 | A | 11/1981 | Eventoff |
| 4,313,113 | A | 1/1982 | Thornburg |
| 4,314,228 | A | 2/1982 | Eventoff |
| 4,315,238 | A | 2/1982 | Eventoff |
| 4,552,360 | A | 11/1985 | Bromley |
| 4,615,252 | A | 10/1986 | Asahi |
| 4,673,919 | A | 6/1987 | Kataoka |
| 4,694,231 | A | 9/1987 | Alvite |
| 4,733,214 | A | 3/1988 | Andersen |
| 4,786,895 | A | 11/1988 | Castaneda |
| 4,866,542 | A | 9/1989 | Shimada |
| 4,975,676 | A | 12/1990 | Greenhalgh |

(List continued on next page.)

FOREIGN PATENT DOCUMENTS

| | | |
|---|---|---|
| DE | 3031484 | 11/1982 |
| DE | 3543890 | 6/1987 |
| DE | 3634912 | 4/1988 |
| DE | 4019211 | 1/1991 |
| DE | 19606408 | 8/1997 |

(List continued on next page.)

OTHER PUBLICATIONS

S.F. Kambic, IBM Technical Disclosure Bulletin, full article sent vol. 20 No. 5 Oct. 1977.

IBM Technical Disclosure Bulletin pp230–235 Feb. 1990 Mouse Ball–Actuating Device With Forge And Tactile Feedback full article sent.

Research Disclosure Nov. 1987 28373 Joystick with Tactile Feedback full article sent.

*Primary Examiner*—Karl D. Easthom

(57) ABSTRACT

An analog sensor depressible by a single human finger/thumb. Depressive force is applied to a dome-cap and to analog materials for varying an analog output of the sensor responsive to varying force applied by a single finger or thumb. Depressive force causes the dome-cap to bow downward passing through a user discernable threshold, causing a snap-through tactile sensation. In some embodiments the dome-cap is metallic.

24 Claims, 14 Drawing Sheets

U.S. PATENT DOCUMENTS

| | | | |
|---|---|---|---|
| 5,103,404 | A | 4/1992 | McIntosh |
| 5,132,658 | A | 7/1992 | Dauenhauer et al. |
| 5,164,697 | A | 11/1992 | Kramer |
| 5,189,355 | A | 2/1993 | Larkins |
| 5,196,782 | A | 3/1993 | D'Aleo et al. |
| 5,200,597 | A | 4/1993 | Eastman |
| 5,207,426 | A | 5/1993 | Inoue |
| D342,740 | S | 12/1993 | Parker |
| 5,287,089 | A | 2/1994 | Parsons |
| 5,311,779 | A | 5/1994 | Teruo |
| 5,315,204 | A | 5/1994 | Park |
| 5,364,108 | A | 11/1994 | Esnouf |
| 5,365,494 | A | 11/1994 | Lynch |
| 5,376,913 | A | 12/1994 | Pine |
| 5,396,235 | A | 3/1995 | Maeshima |
| 5,440,237 | A | 8/1995 | Brown |
| 5,457,478 | A | 10/1995 | Frank |
| 5,550,339 | A | 8/1996 | Haugh |
| 5,565,891 | A | 10/1996 | Armstrong |
| 5,589,828 | A | 12/1996 | Armstrong |
| 5,640,566 | A | 6/1997 | Victor |
| 5,670,955 | A | 9/1997 | Thorne |
| 5,673,237 | A | 9/1997 | Blank |
| 5,675,329 | A | 10/1997 | Barker |
| 5,689,285 | A | 11/1997 | Asher |
| 5,764,219 | A | 6/1998 | Rutledge |
| 5,778,404 | A | 7/1998 | Capps |
| 5,790,102 | A | 8/1998 | Nassima |
| 5,847,305 | A | 12/1998 | Yoshikawa |
| 5,847,639 | A | 12/1998 | Yaniger |
| 5,854,624 | A | 12/1998 | Grant |
| 5,867,808 | A | 2/1999 | Selker et al. |
| 5,883,619 | A | 3/1999 | Ho |
| 5,889,236 | A | 3/1999 | Gillespie |
| 5,895,471 | A | 4/1999 | King |
| 5,898,359 | A | 4/1999 | Ellis |
| 5,910,798 | A | 6/1999 | Kim |
| 5,943,044 | A | 8/1999 | Martinelli |
| 5,948,066 | A | 9/1999 | Whalen |
| 5,974,238 | A | 10/1999 | Chase |
| 5,995,026 | A | 11/1999 | Sellers |
| 5,999,084 | A | 12/1999 | Armstrong |
| 6,020,884 | A | 2/2000 | MacNaughton |
| 6,049,812 | A | 4/2000 | Bertram |
| 6,102,802 | A | 8/2000 | Armstrong |
| 6,118,979 | A | 9/2000 | Powell |
| 6,135,886 | A | 10/2000 | Armstrong |
| 6,157,935 | A | 12/2000 | Tran |
| 6,185,158 | B1 | 2/2001 | Ito |
| 6,198,473 | B1 | 3/2001 | Armstrong |
| 6,208,271 | B1 | 3/2001 | Armstrong |
| 6,222,525 | B1 | 4/2001 | Armstrong |
| 6,351,205 | B1 * | 2/2002 | Armstrong ..... 338/114 |

FOREIGN PATENT DOCUMENTS

| | | |
|---|---|---|
| EP | 0337458 | 10/1989 |
| EP | 0470615 | 2/1992 |
| EP | 0579448 | 11/1994 |
| EP | 1080753 | 3/2001 |
| GB | 2058462 | 4/1981 |
| GB | 2113920 | 8/1983 |
| GB | 2233499 | 1/1991 |
| GB | 2267392 | 12/1993 |
| GB | 2308448 | 6/1997 |
| JP | 601 75401 | 9/1985 |
| JP | 62160623 | 7/1987 |
| JP | 02158105 | 6/1990 |
| JP | 03108701 | 5/1991 |
| JP | 04155707 | 5/1992 |
| JP | 5-87760 | 4/1993 |
| JP | 05151828 | 6/1993 |
| JP | 6154422 | 6/1994 |
| JP | 7281824 | 10/1995 |
| JP | 7302159 | 11/1995 |
| JP | 09213168 | 8/1997 |
| JP | 9218737 | 8/1997 |
| JP | 09223607 | 8/1997 |
| JP | 11031606 | 2/1999 |
| RU | 2010369 | 3/1994 |
| WO | WO9532776 | 12/1995 |
| WO | WO9957630 | 11/1999 |

* cited by examiner

ANALOG SENSOR(S) WITH SNAP-THROUGH TACTILE FEEDBACK

CROSS-REFERENCE TO RELATED APPLICATION(S)

This application is a divisional of U.S. patent application Ser. No. 09/455,521 Dec. 7, 1999 now abandoned and which the specification in herein incorporated by reference. U.S. patent application Ser. No. 09/455,521 is a continuation of U.S. patent application Ser. No. 09/106,825, filed Jun. 29, 1998, now U.S. Pat. No. 5,999,084, the entire contents of which are hereby incorporated by reference. This application is also a continuation-in-part of U.S. patent application Ser. No. 08/677,378 filed Jul. 5, 1996, now U.S. Pat. No. 6,222,525.

BACKGROUND OF THE INVENTION

1. Field of the Invention

The present invention relates to electrical sensors of the type useful for controlling electrical flow through a circuit. The present invention specifically involves the use of a tactile feedback dome-cap in conjunction with pressure-sensitive variable-conductance material to provide momentary-On pressure dependant variable electrical output. The tactile feedback is user discernable for indicating actuation and de-actuation of the sensor.

2. Description of the Related Prior Art

The prior art of record in the file of U.S. patent application Ser. No. 09/455,521 of which this is a Divisional continuation is applicable and related.

There are many prior art types of switches (sensors) and switch packages. While used widely in many-fields, switches and switch packages are used in game controllers for use in controlling imagery, and in computer keyboards, other computer peripherals, and in many other host devices not related to computers.

A very common prior art switch is comprised of: a housing typically of non-conductive plastics; a first and a second conductive element fixed to the housing and in-part within the housing and in-part exposed external of the housing; a conductive dome-cap typically made of metal having a degree of resiliency and positioned within a recess of the housing and between a depressible actuator and the two conductive elements. The actuator is retained to the housing via a flange of the actuator positioned beneath a housing plate with a portion of the actuator extending through a hole in the housing plate to be exposed external of the housing and thus accessible for depression by a mechanical member or a human finger or thumb. Typically, at the four corners of the housing are plastic studs formed of continuations of the housing material. The distal ends of the studs pass through aligned holes in the housing plate, and when the housing plate is properly located, the distal ends of the studs are flattened and enlarged commonly using heating and mechanical pressure so as to retain the housing plate to the housing. The conductive elements are typically highly conductive and serve as electrical conductors but also sometimes additionally serve as mechanical members or legs for structural attachment to circuit boards, although they are often connected directly to wires. The two conductive elements are separated from one another within the housing in a normally open arrangement or fashion. An end portion of the first conductive element within the housing is positioned to be in constant contact with an edge of the dome-cap. Sufficient depression of the actuator causes the actuator to apply force to the dome-cap, causing the dome-cap to bow (snap-through) downward, causing a center portion of the dome-cap to contact a more centrally positioned end of the second conductive element and resulting in a conductive bridging or closing-between the first and second conductive elements with the current flow path being through the conductive dome-cap. The dome-cap when pressed against sufficiently to bow toward the second conductive element has resistance to moving which begins low and increases toward a snap-through threshold wherein at the threshold the dome-cap snaps creating a snap or click which is user discernable in the form of a tactile sensation. The dome-cap then moves further toward the second conductive element. The dome-cap being of resilient design, returns to a raised position off of the second conductive element when the actuator is no longer depressed, and thus the switch or sensor is a momentary-on type. A tactile sensation is also produced by the dome-cap upon returning to the normally raised position and in doing so moving back through the snap-through threshold. As those skilled in the art recognize, the portion of the actuator which is external of the housing can be of numerous sizes and shapes, for example to accommodate attachment of extending and/or enclosing members such as buttons and the like, etc.

Such prior art switches are either On or Off and provide corresponding all or nothing outputs. These simple On/Off switches are not structured to provide the user proportional or analog control which is highly desirable and would be very beneficial in many applications.

Another type of prior art sensor is described in U.S. Pat. No. 3,806,471 issued Apr. 23, 1974 to R. J. Mitchell for "PRESSURE RESPONSIVE RESISTIVE MATERIAL". Mitchell describes sensors which utilize pressure-sensitive variable-conductance material to produce analog outputs. However, Mitchell fails to recognize any need for tactile feedback to the user upon actuation and de-actuation of the sensor. Thus, Mitchell fails to anticipate any structuring useful for providing a tactile feedback discernable to a human user of his sensors.

There have been hundreds of millions of momentary-On snap switches made and sold in the last 25 years. Pressure-sensitive variable-conductance sensors have also been known for decades, and yet the prior art does not teach a pressure-sensitive variable-conductance sensor which includes tactile feedback to the user upon actuation and de-actuation of the sensor. Clearly a pressure-sensitive variable-conductance sensor which included tactile feedback to the user would be of significant usefulness and benefit, particularly if provided in a structural arrangement which was inexpensive to manufacture. Such a sensor would be useful in a wide variety of applications wherein human input is required. Such applications would include home electronics, computers and generally devices operated by the human hand/finger inputs.

SUMMARY OF THE INVENTION

The following summary and detailed description is of preferred structures and best modes for carrying out the invention, and although there are clearly variations which could be made to that which is specifically herein described and shown in the included drawings, for the sake of brevity of this disclosure, all of these variations and changes which fall within the true scope of the present invention have not been herein detailed, but will become apparent to those skilled in the art upon a reading of this disclosure.

The present invention involves the use of pressure-sensitive variable-conductance material electrically positioned as a variably conductive element between highly conductive elements in a structural arrangement capable of providing variable electrical output coupled with structuring for providing tactile feedback upon depression of an depressible actuator, and preferably tactile feedback with termination of the depression of the actuator. The tactile feedback is preferably discernable for both actuation and de-actuation of the sensor, the actuation and de-actuation of the sensor controllable by way of depression and release of the depressible actuator.

The present invention provides a pressure-sensitive variable electrical output sensor which produces a tactile sensation discernable to the human user to alert the user of the sensor being activated and deactivated.

A sensor in accordance with the present invention provides the user increased control options of host devices, the ability to variably increase and reduce the sensor output dependant on pressure exerted by the user to a depressible actuator so that, for example, images may selectively move faster or slower on a display, timers, settings, adjustments and the like may change faster or slower dependant on the pressure applied by the user. A benefit provided by a sensor in accordance with the present invention is a reduction of confusion or potential confusion on the part of the user as to when the analog (proportional) sensor is actuated and de-actuated. If an analog/proportional sensor of the type not having tactile feedback is minimally activated, it is difficult for the user in some instances to determine whether the sensor is still minimally activated or is entirely de-activated. For example, if the user is playing an electronic game utilizing a variable pressure analog sensor to control a fire rate of a gun, and desires the gun to be firing very slowly, i.e., one shot every 5 seconds or so, the user would be depressing very lightly on the sensor, and would not be immediately aware when he inadvertently decreased the depression enough to fully deactivate the sensor. Conversely for example, without tactile feedback in the same arrangement, the user of the electronic game may desire that gun should begin to fire very slowly such as to conserve ammo, and by lightly depressing on the sensor the fire rate would be slow, however the user does not immediately receive any notice even upon minimal activation of the sensor and thus might initially depress so firmly as to cause a firing volley and expend excessive ammo. The present invention solves the above and like problems.

Another example of reduced confusion of the user would be brought about through the use of the present invention in devices having a single operable member operable through a plurality of axes with each axis associated with one or two sensors. Such a device which would be benefited by the application of the present invention would be my SIX DEGREE OF FREEDOM CONTROLLER of U.S. Pat. No. 5,565,891.

Still another benefit of the present sensor is that the preferred structure is inexpensive to manufacture, costing essentially the same or just slightly more than prior art momentary-On tactile switches of the type manufactured in large volume and highly automated manufacturing facilities.

Further, a sensor in accordance with a preferred embodiment of the present invention is structured to allow manufacturing of the sensor absent major and costly tooling and assembly line changes to existing large volume, highly automated manufacturing facilities.

Additionally, a sensor in accordance with a preferred embodiment of the present invention is structured in a familiar format having a housing and electrical connectors similar to high-volume prior art momentary-On switches so that designers may easily substitute the present invention sensors directly for the prior art devices and receive the corresponding benefits of the new improved sensors. For example, where prior art momentary-On switches are utilized as sensors located within a joystick handle for buttons located on the handle operable by the user's fingers (or thumbs), the present sensor can be substituted for the prior art switches without re-tooling the mounting structures within the joystick handle and without retraining of workers who install the sensors.

A yet still further benefit of a sensor in accordance with a preferred embodiment of the present invention is that the sensor is an integrally packaged unit, i.e., manufactured in a complete packaged unit containing pressure-sensitive variable-conductance material, two proximal highly conductive elements, a depressible actuator, a resilient dome-cap for providing tactile feedback, and all integrated together with a housing, thereby providing ease of handling and installation, among other benefits.

These, as well as other benefits and advantages of the present invention will be increasingly appreciated and understood with continued reading and with a review of the included drawings.

BEST MODE FOR CARRYING OUT THE INVENTION

A detailed description of the principles of the present invention along with specific structural embodiments in accordance with the invention and provided for example will now ensue with reference to the included drawings.

Figure 1:
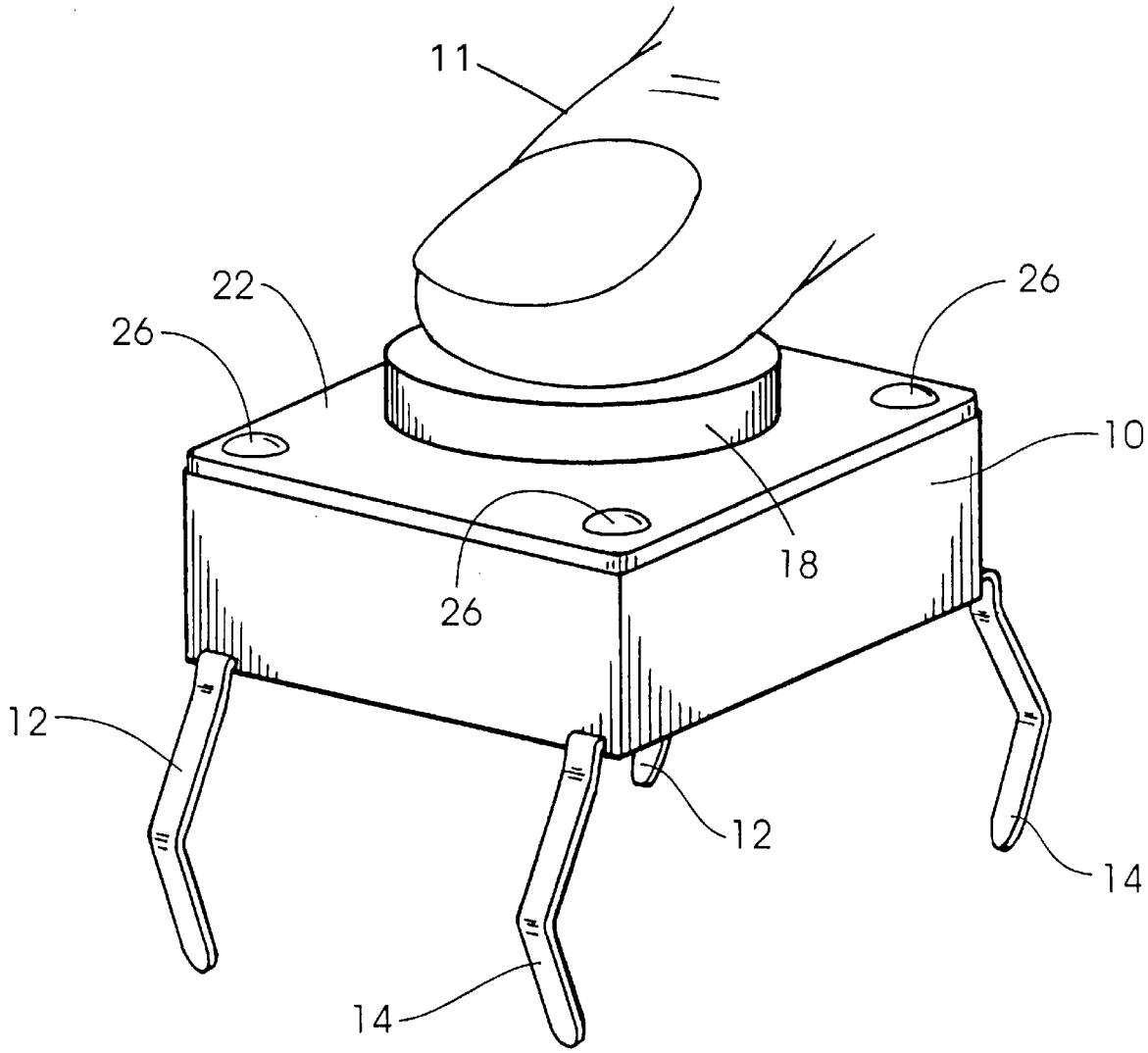
FIG. 1 shows flat mount sensor or switch package.

FIG. 1 shows flat mount sensor package which appears as many prior art switches or sensors. The present invention can also appear as shown in FIG. 1.

Figure 2:
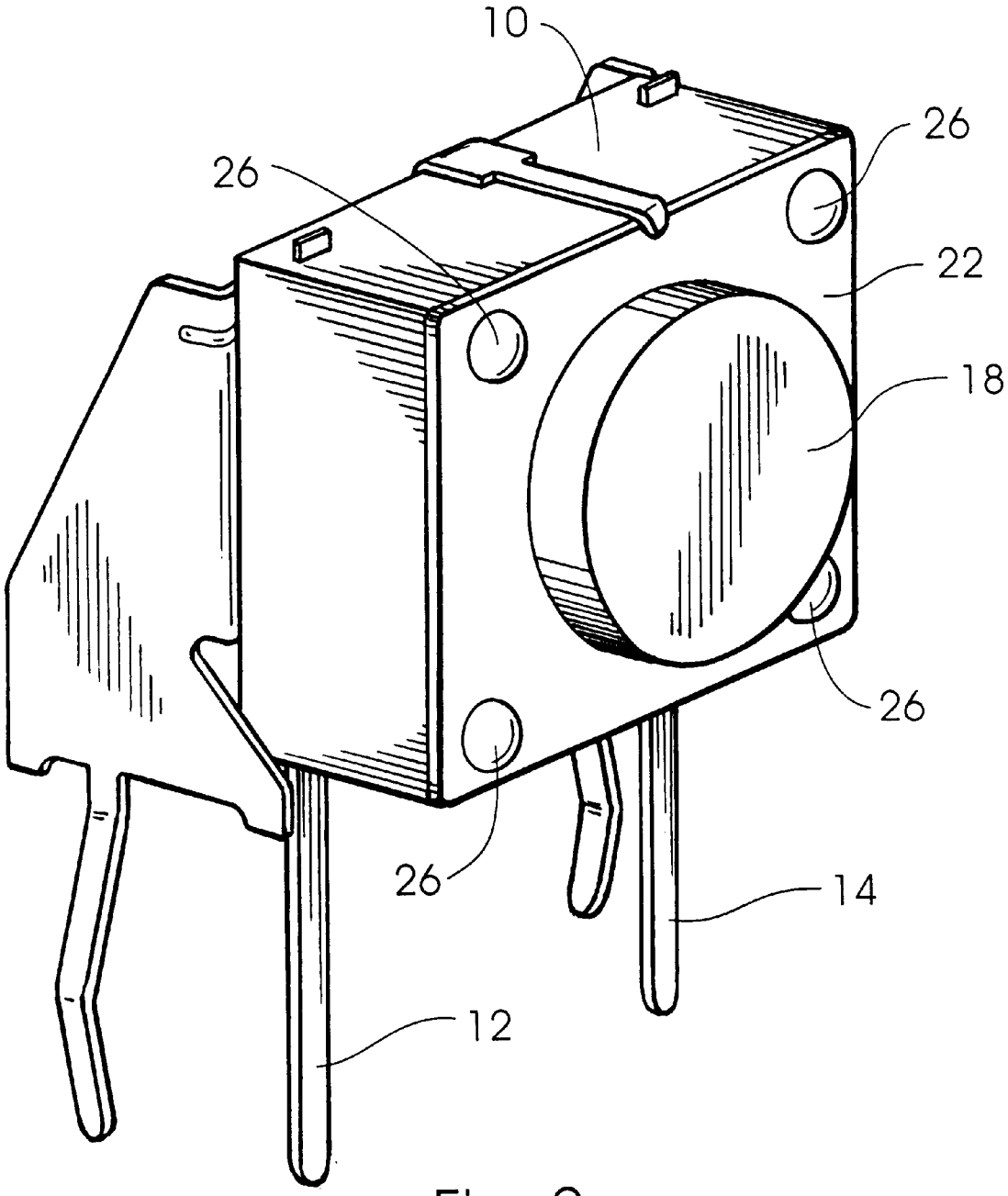
FIG. 2 shows a right angle mount sensor or switch package.

FIG. 2 shows a right angle mount sensor package which appears as many prior art switches or sensors. The present invention can also appear as shown in FIG. 2.

Figure 3:
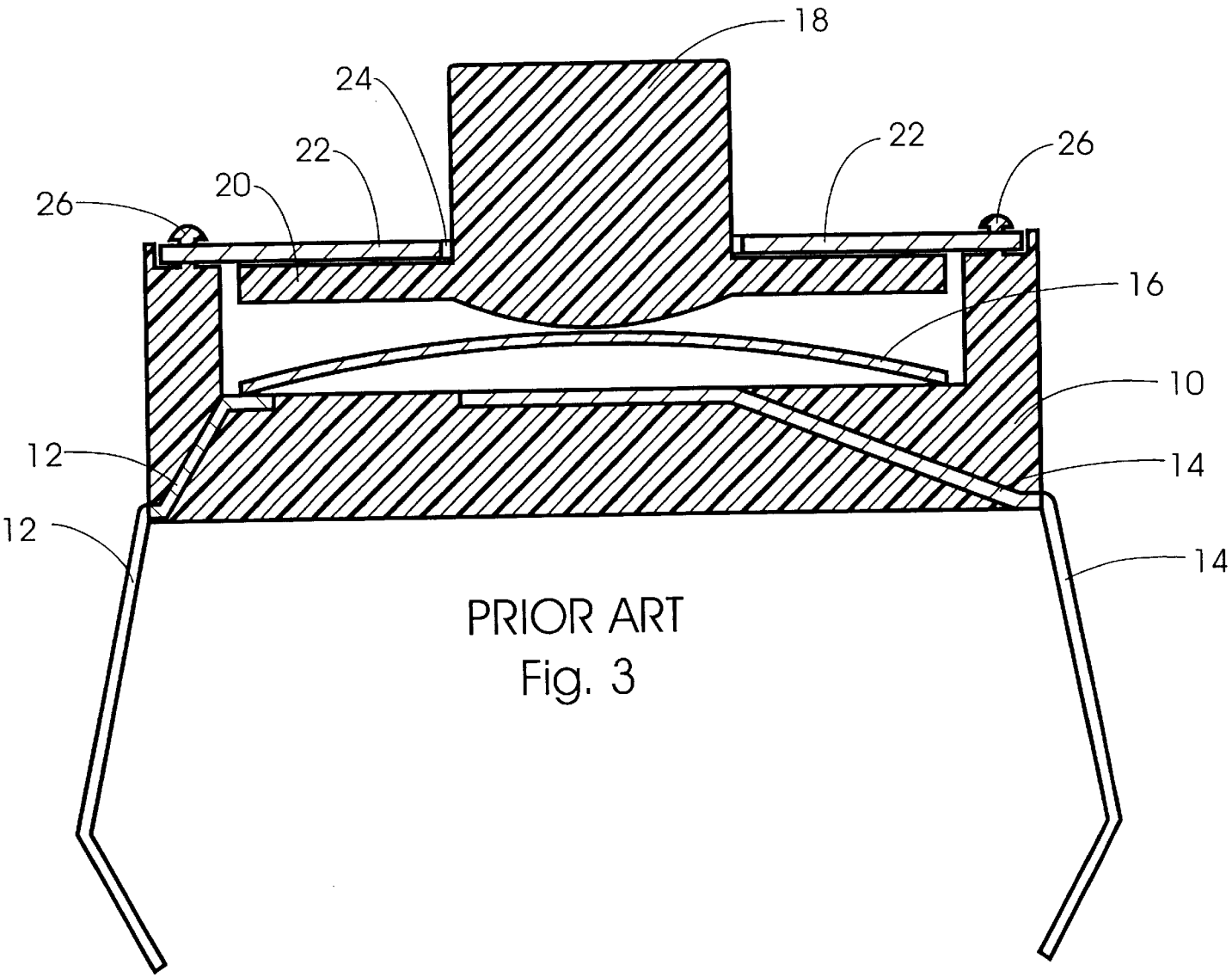
PRIOR ART Fig. 3
FIG. 3 shows a median cross section view of a prior art flat mount switch package.

FIG. 3 shows a median cross section view of a prior art flat mount sensor package showing structuring thereof and which is common to some of the present sensor embodiments, but lacking pressure-sensitive variable-conductance material 30 (see FIGS. 4 through 13) as used in the present invention. Shown in FIG. 3 is a housing 10 typically of non-conductive plastics; two conductive elements 12 and 14 which are highly conductive and of fairly constant conductivity; the conductive elements 12, 14 each fixed to housing 10 and in-part within housing 10 and in-part exposed external of housing 10. Conductive elements 12, 14 are herein sometimes referred to as first conductive element 12 and second conductive element 14, and are typically formed via stamping and bending of sheet metal. Typically, housing 10 is of non-conductive plastics molded around portions of conductive elements 12 and 14 so as to retain the conductive elements in proper location to housing 10. As those skilled in the art understand, those portions or legs of conductive elements 12, 14 external of housing 10 serve as electrical conductors but also sometimes additionally serve as mechanical members for structural attachment to circuit boards, additionally they are sometimes connected such as by soldering directly to wires with housing 10 retained in a supportive socket of a host device. Also shown is a conductive dome-cap 16 typically made of metal, and positioned within a large recess or the interior open space defined by housing 10 and between a depressible actuator 18 and conductive elements 12, 14. In some embodiments of the present sensor it is not necessary that dome-cap 16 be electrically conductive, and in other embodiments dome-cap 16 must be conductive as will become appreciated with continued reading. In FIG. 3, actuator 18 is retained to housing 10 via a flange 20 of actuator 18 positioned beneath a housing plate 22 with a portion of actuator 18 extending through a hole 24 in housing plate 22 to be exposed external of housing 10 and thus accessible for depression by a finger, thumb or mechanical device. Typically at four corners of housing 10 are plastic studs 26 formed of continuations of the material of housing 10. The distal ends of studs 26 pass through aligned holes in housing plate 22, and when housing plate 22 is properly located, the distal ends of studs 26 are flattened and enlarged commonly using heating and mechanical pressure so as to retain housing plate 22 to housing 10. Conductive elements 12, 14, are shown separated from one another within housing 10 and in a normally open state or circuit, being separated by space and the insulating material defining housing 10. An end portion of first conductive element 12 within housing 10 is shown positioned in constant contact with a side edge of dome-cap 16. Dome-caps 16, as those skilled in the art understand, are typically circular disks having a domed or concavo-convexed shape. In the FIG. 3 prior art embodiment, depression of actuator 18 sufficiently causes dome-cap 16 to bow downward causing a center portion of dome-cap 16 to contact a more centrally positioned end of second conductive element 14 normally not in contact with dome-cap 16. The contacting of the center portion of dome-cap 16 with second conductive element 14 cause an electrical bridging or closing between first and second conductive elements 12, 14 through conductive dome-cap 16. Dome-cap 16 when pressed against sufficiently to bow toward second conductive element 14 has resistance to moving, the resistance begins relatively low and increases toward a snap-through threshold wherein at the snap-through threshold dome-cap 16 "snaps-through" and moves further downward. A snap or click (tactile sensation) can be felt and in some applications heard (user discernable tactile feedback) as dome-cap 16 snaps-through its threshold. The snap-through dome-cap 16 being of resilient design, returns to a raised position off of second conductive element 14 when actuator 18 is no longer depressed, and thus the switch or sensor is a momentary-On type. The snap-through dome-cap 16 typically returns to a raised position off of second conductive element 14 and creates a user discernable tactile feedback while moving to the raised position. Also, commonly the resiliency of the dome-cap 16 is used as the return spring for depressible actuator 18, holding the actuator 18 raised or outward when not depressed by an external force. As those skilled in the art recognize, the portion of actuator 18 which is external of housing 10 can be of numerous sizes and shapes, for example to accommodate the attachment of or contacting of extending and/or enclosing members such as buttons, triggers and the like, etc. The present invention also allows for various sizes and shapes of actuator 18.

FIG. 1 shows four extensions external of housing 10 which those skilled in the art understand are in effect two conductive elements 12, 14 wherein two of the extensions represent portions of first conductive element 12 external to housing 10, and the other two extensions represent portions of second conductive element 14; as is common in many prior art switch packages for allowing increased strength and options in mechanical and electrical connecting, and such multi-extension external of housing 10 for each conductive element 12, 14 can also be used with the present invention. A single thumb 11 or finger 11 is shown depressing actuator 18 in FIG. 1. In the FIG. 2 right angle mount sensor, four extending legs are shown, and in the example shown, two of the extending legs are simply mechanical structures for aiding in mounting the sensor, and two of the extending legs represent the conductive elements 12 and 14 of the sensor, although clearly all four legs could be arranged as conductive elements 12 and 14 as in the flat mount sensor of FIG. 1 wherein two legs represent conductive element 12, and the other two legs would represent conductive elements 14.

As those skilled in the art understand, the term electrical or electrically insulating is relative to the applied voltage.

Figure 4:
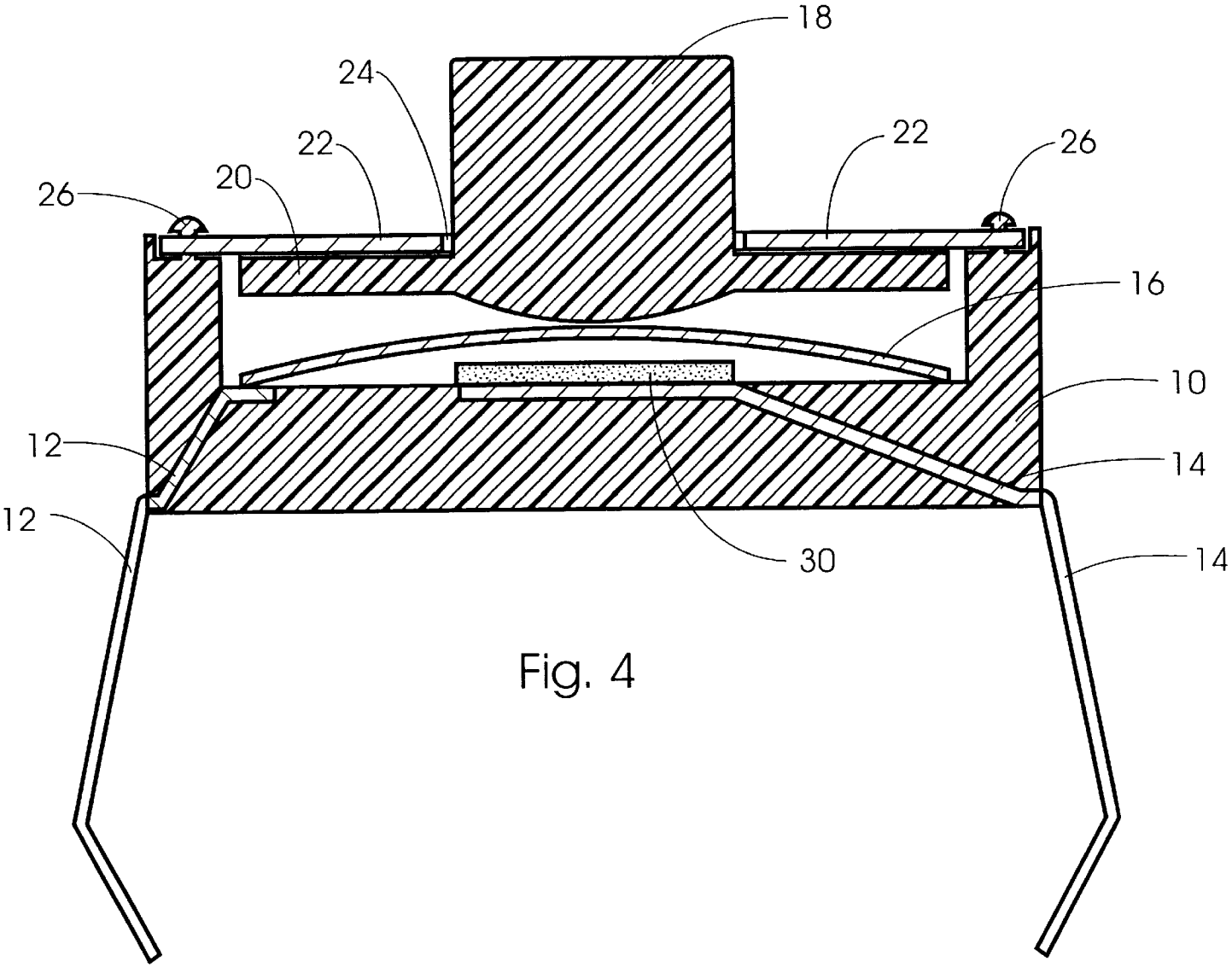
FIG. 4 shows a median cross section view of a flat mount sensor package in accordance with the present invention.

FIG. 4 shows a median cross section view of a flat mount sensor in accordance with the present invention and structured the same as the FIG. 3 sensor with the exception of the installation of a pressure-sensitive variable-conductance material 30 shown contacting and adhered in place on second conductive element 14 within housing 10. Conductive dome-cap 16 is shown in constant contact with first conductive element 12, and operationally, pressure-sensitive variable-conductance material 30 is positioned as a variably conductive element electrically between the first and second conductive elements 12, 14 such that depression of actuator 18 will depress dome-cap 16 pushing it through it's snap-through threshold resulting in a tactile feedback and dome-cap moving further presses onto pressure-sensitive variable-conductance material 30 to cause variable conductively dependant upon the degree of force thereagainst, and electricity will flow between first and second conductive elements 12, 14 with both pressure-sensitive variable-conductance material 30 and dome-cap 16 in the current flow path.

At this point in the disclosure it should be quite clear that the pressure-sensitive variable-conductance material 30 is a very important aspect, as is equally the tactile feedback from the snap-through dome-cap 16 of the present invention. Additionally, while the present invention can be viewed as an improved pressure-sensitive variable-conductance sensor improved by way of integrating a tactile feedback dome-cap therein, the invention can also be viewed as an improved momentary-On snap switch improved by way of integrating pressure-sensitive variable-conductance material electrically into a current flow path between the first and second conductive elements. Without regard to how one views the present invention, sensors structured in accordance with the invention can be used in a wide variety of host devices in ways which can improve the usefulness, convenience and cost effectiveness of the host devices.

With the present invention, variable conductance can be achieved with materials having either variable resistive properties or variable rectifying properties. For the purpose of this disclosure and the claims, variable-conductance means either variably resistive or variably rectifying. Material having these qualities can be achieved utilizing various chemical compounds or formulas some of which I will herein detail for example. Additional information regarding such materials can be found in the Mitchell U.S. Pat. No 3,806,471 describing various feasible pressure-sensitive variable-conductance material formulas which can be utilized in the present invention. While it is generally anticipated that variable resistive type active materials are optimum for use in the pressure sensor(s) in the present invention, variable rectifying materials are also usable.

An example formula or compound having variable rectifying properties can be made of any one of the active materials copper oxide, magnesium silicide, magnesium stannide, cuprous sulfide, (or the like) bound together with a rubbery or elastic type binder having resilient qualities such as silicone adhesive or the like.

An example formula or compound having variable resistive properties can be made of the active material tungsten carbide powder (or other suitable material such as molybdenum disulfide, sponge iron, tin oxide, boron, and carbon powders, etc.) bound together with a rubbery or elastic type binder such as silicone rubber or the like having resilient qualities. The active materials may be in proportion to the binder material typically in a rich ratio such as 80% active material to 20% binder by volume ranging to a ratio 98% to 2% binder, but can be varied widely from these ratios dependant on factors such as voltages to be applied, level or resistance range desired, depressive pressure anticipated, material thickness of applied pressure-sensitive variable-conductance material, surface contact area between the pressure-sensitive variable-conductance material and conductive elements 12, 14, whether an optional conductive plate 34 is to be used, binder type, manufacturing technique and specific active material used.

Figure 7:
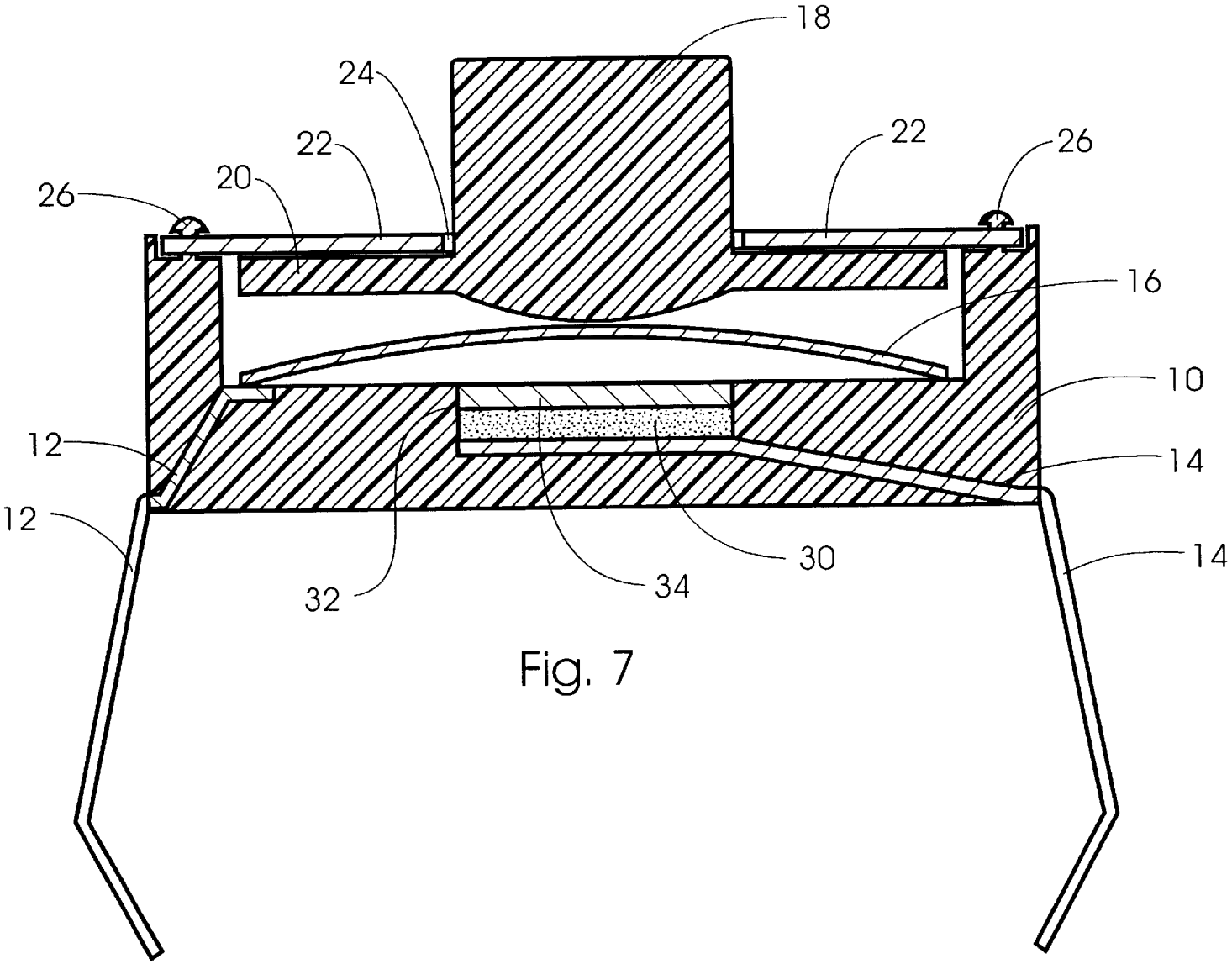
FIG. 7 shows a median cross section view of a flat mount sensor package in accordance with another embodiment of the present invention.
Figure 11:
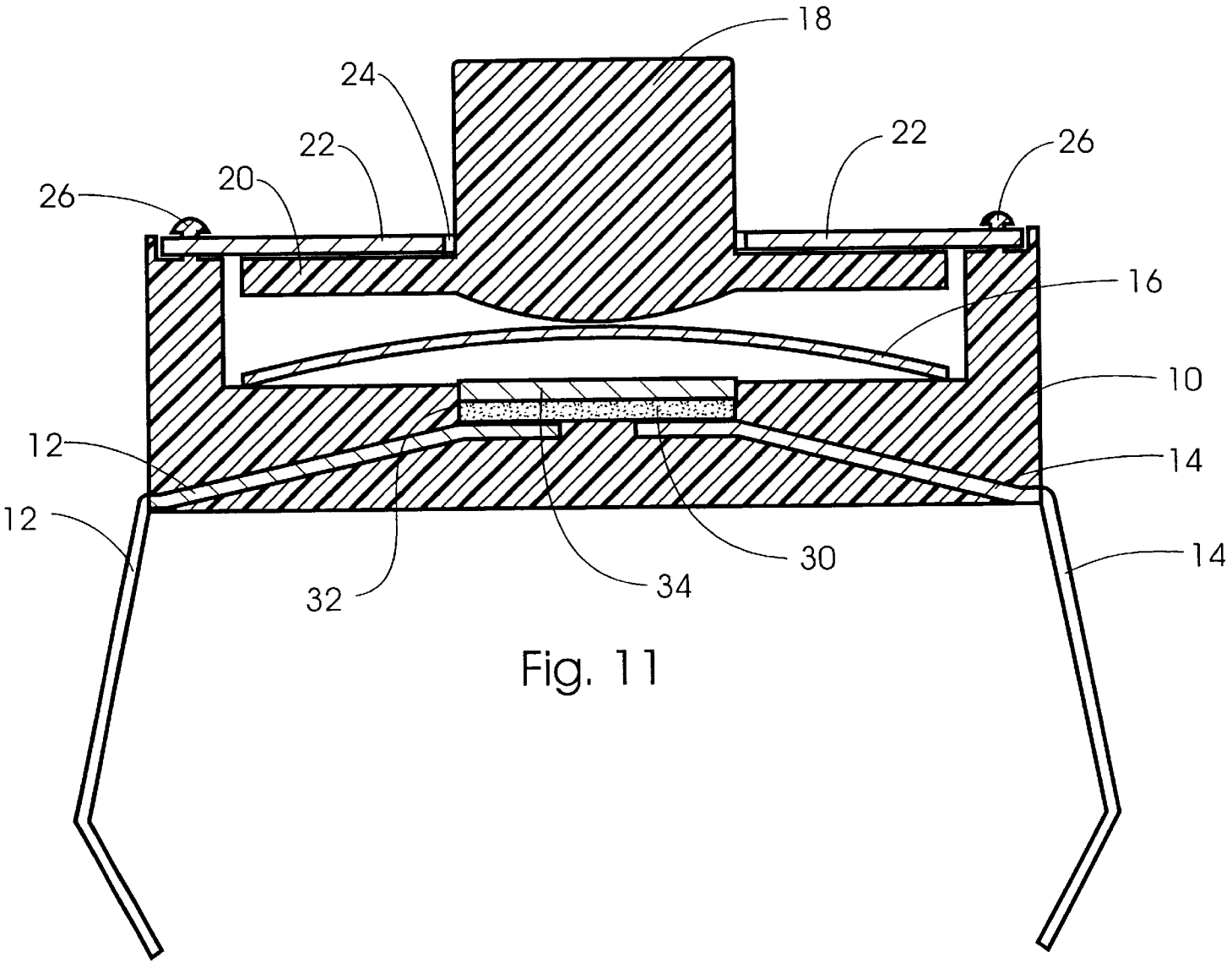
FIG. 11 shows a median cross section view of a flat mount sensor package in accordance with another embodiment of the present invention.

A preferred method of manufacture for portions of that which is shown in FIGS. 7 and 11, i.e., material 30 with conductive cap 34, is to create a sheet of pressure-sensitive variable-conductance material 30 adhered to a conductive sheet such as steel, aluminum or copper, for example, by applying a mixture of the still fluid variable-conductance material to the conductive sheet in a thin even layer before the binder material has cured. After the binder material has cured and adhered to the conductive sheet, a hole punch is used to create circular disks of the lamination of the conductive sheet and pressure-sensitive variable-conductance material. The disks may then be secured relative to any desired surface for contacting with circuit elements. Securing of the disks may be accomplished with the use of adhesives, or with the silicone rubber as used in the formula to make pressure-sensitive variable-conductance material, or with any other suitable means. The adhesive should be spread thin or of a type such that significant electrical insulation is avoided. Alternatively, disks of the material 30 can be formed by way of applying a thin layer of the still fluid variable-conductance material to a surface such as non-stick surface, and after the binder material has cured, removing the sheet of cured material 30 and using a hole punch or cutting-die such as a rotary die-cut process, create disks of the material 30 of a desired dimension. Another alternative to form the material 30 into a desired disk shape is to inject or press the still fluid variable-conductance material 30 into a mold such as a cylindrical tube having an interior diameter commensurate with the exterior size and shaped of desire disk, allow the mixture to cure, and then open the mold to remove the material or press the material from the mold, and then slice the material 30 into the desired thickness. Other methods of defining material 30 into suitable shapes and sizes such as squirting from an applicator gun or otherwise applying the uncured material directly in place in the sensor, and then waiting for it to cure, can be used within the scope of the invention.

With the present sensor in all embodiments shown and described herein, pressure-sensitive variable-conductance material 30 is positioned as a variably conductive element electrically between first conductive element 12 and second conductive element 14, although in some embodiments snap-through dome-cap 16 must be electrically conductive for current flow to occur as will be appreciated with continued reading. Applied physical pressure is provided by a user depressing actuator 18 which applies pressure onto snap-through dome-cap 16 which moves onto pressure-sensitive variable-conductance material 30 which, dependant upon the force of the applied pressure, alters its conductivity (i.e., resistive or rectifying properties dependant upon the pressure sensor material utilized) and thereby provides analog electrical output proportional to the applied pressure, assuming a difference in electrical potential exists between conductive elements 12 and 14. The analog electrical output of the variable-conductance material 30 is output into or through or used in circuitry connected to the exposed portions of conductive elements 12, 14 and capable of using such output in a manner which is representational of the pressure applied by the user.

Further principles and structural examples of the invention will now be described. It should be noted that flat mount sensors and right angle mount sensors in accordance with the present invention are electrically the same and generally only differ in the angular extension of the externally exposed conductive elements 12 and 14 relative to housing 10 and the exposed portion of actuator 18.

Figure 5:
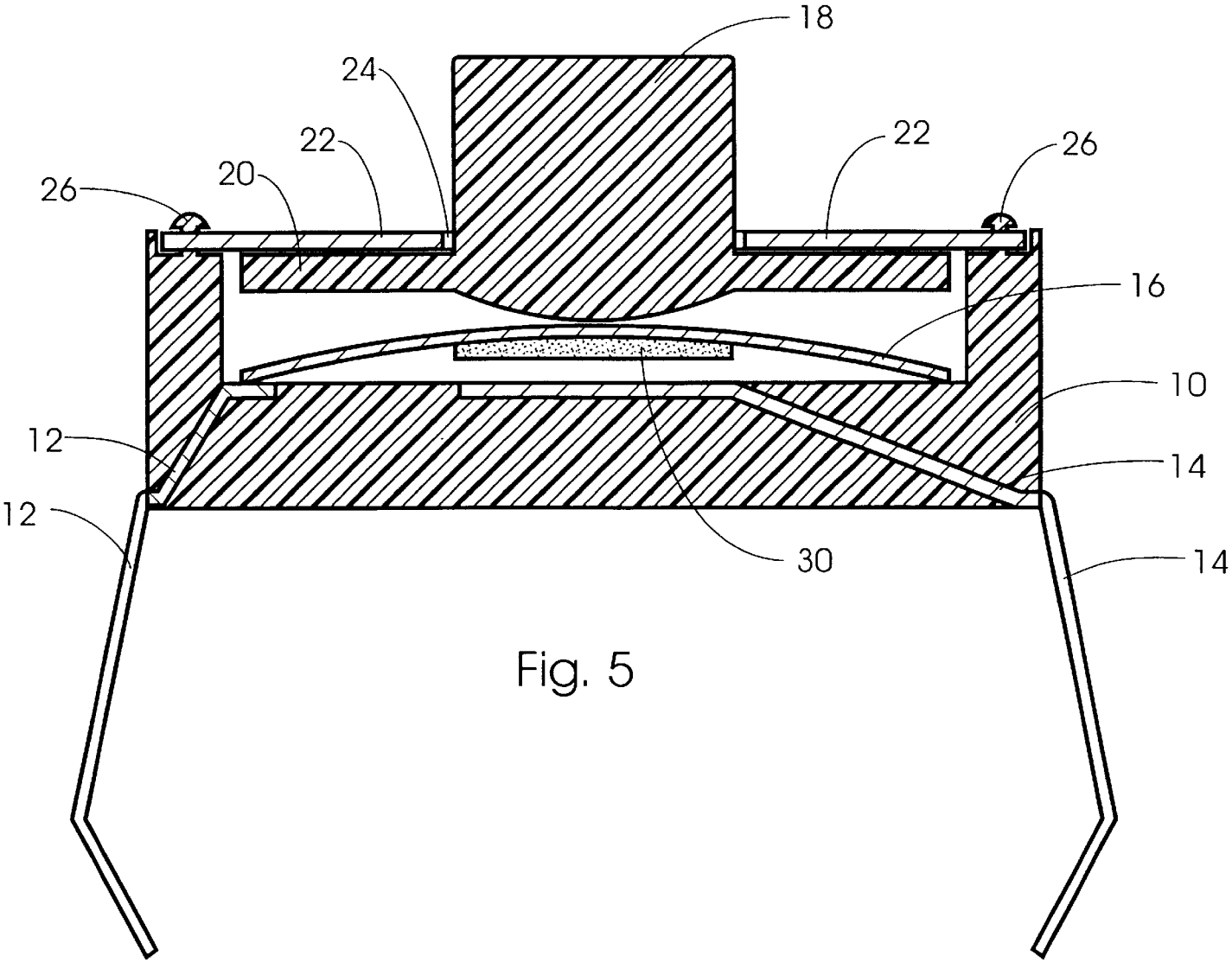
FIG. 5 shows a median cross section view of a flat mount sensor package in accordance with another embodiment of the present invention.

FIG. 5 shows a median cross section view of a flat mount sensor package in accordance with another embodiment of the present invention similar to the FIG. 4 sensor and showing pressure-sensitive variable-conductance material 30 adhered to the underside of dome-cap 16 within housing 10 and held normally off but adjacent second conductive element 14. In this example, snap-through dome-cap 16 is electrically conductive and in constant contact with first conductive element 12. Pressure-sensitive variable-conductance material 30 is held off of or at least not held under significant pressure against the centrally positioned portion of second conductive element 14 by the normally raised position of snap-through dome-cap 16. Pressure applied to actuator 18 onto dome-cap 16 moves dome-cap 16 through its snap-through threshold causing a tactile feedback to the human user to alert the human user of actuation of the sensor, i.e, the sensor rendered capable of electrical current flow between first and second conductive element 12, 14. Dome-cap 16 which in this example carries pressure-sensitive variable-conductance material 30 then continues toward the central portion of second conductive element 14 and brings pressure-sensitive variable-conductance material 30 into compression against conductive element 14. The tactile feedback and the contacting of pressure-sensitive variable-conductance material 30 against second conductive element 30 may not occur at precisely the same instant, but preferably are sufficiently close as to be generally imperceptible to the human user, and this is generally true of all the present sensors herein described and shown in accordance with the present invention. compressive force against pressure-sensitive variable-conductance material 30 causes it to become sufficiently conductive as to allow current flow therethrough, the degree of conductivity being dependant upon the applied, received or transferred pressure or force, which is controllable by the human user via varying depressive pressure on actuator 18. With variably resistive formula mixes of the pressure-sensitive variable-conductance material 30 as described above, the higher the compressive force thereon, the higher the electrical conductivity, i.e., the lower the resistivity thereof. Upon sufficient release of depressive pressure on actuator 18, dome-cap 16 returns under its own resilience to a normally raised position, the returning of dome-cap 16 raising pressure-sensitive variable-conductance material 30 from conductive element 14 or at least relieving compressive pressure thereon to such a degree as to open the circuit, and desirably also raising or pushing actuator 18 to a normal resting position. When snap-through dome-cap 16 returns, it passes through it's snap-through threshold causing a tactile feedback or sensation detectable by the human user, thereby the human user is alerted to the fact that the sensor has been fully de-actuated or in effect has been rendered electrically open.

Figure 6:
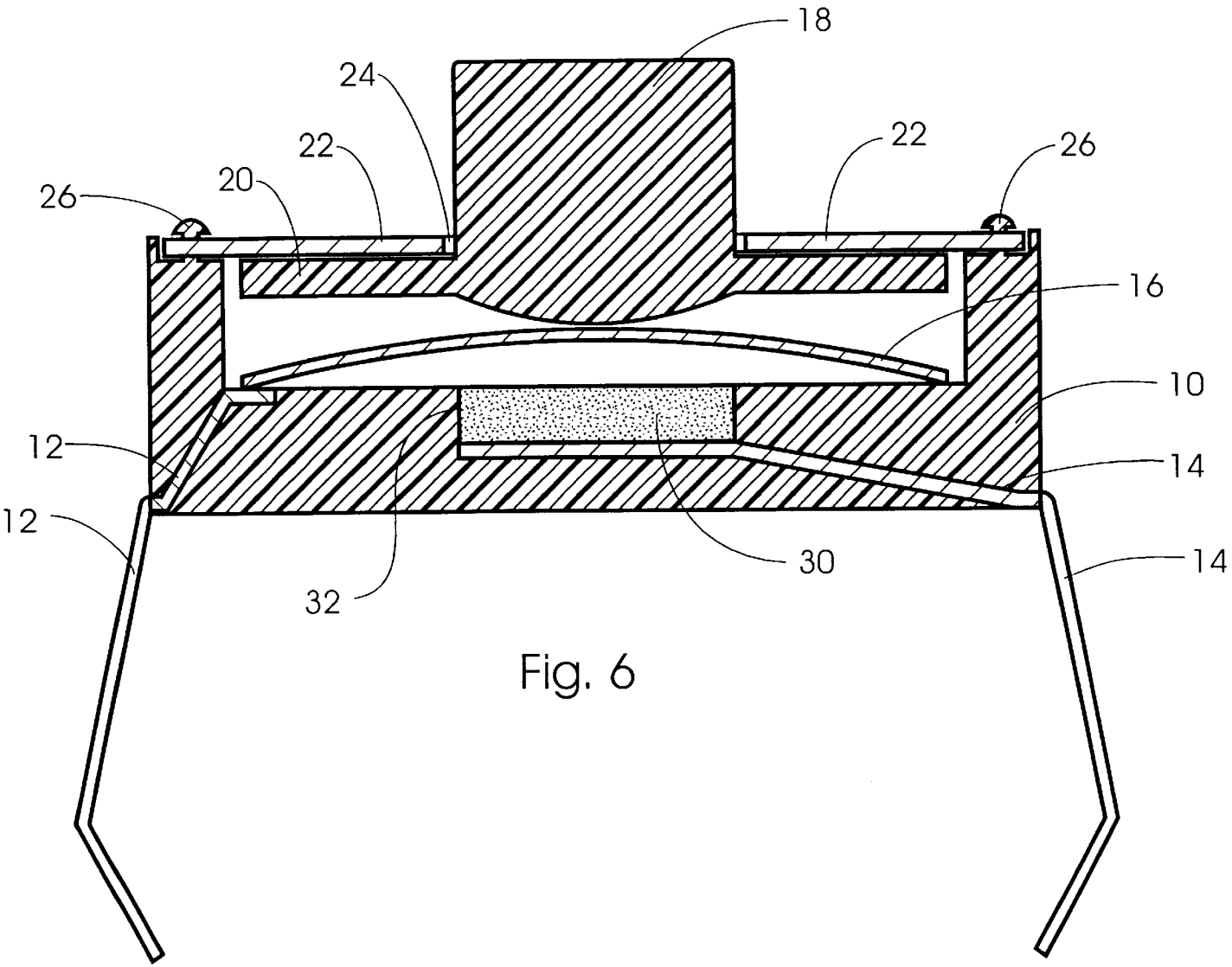
FIG. 6 shows a median cross section view of a flat mount sensor package in accordance with another embodiment of the present invention.

FIG. 6 shows a median cross section view of a flat mount sensor package in accordance with another embodiment of the present invention and showing pressure-sensitive variable-conductance material 30 contacting second conductive element 14 within a well 32 (small recess) within housing 10. Well 32 in this example improves containment of pressure-sensitive variable-conductance material 30. Well 32 offers advantage in containing the pressure-sensitive variable-conductance material 30, but in a broad sense of the invention the sensor will function without well 32. In this example snap-through dome-cap is electrically conductive and in constant contact with first conductive element 12. Pressure applied to actuator 18 onto dome-cap 16 moves dome-cap 16 through its snap-through threshold causing a tactile feedback to the human user to alert the human user of actuation of the sensor, i.e, the sensor rendered capable of some current flow between first and second conductive element 12, 14 via passing through pressure-sensitive variable-conductance material 30 and the conductive dome-cap 16. Dome-cap 16, after snapping-through continues toward and basically instantaneously engages variable-conductance material 30. Compressive force against pressure-sensitive variable-conductance material 30 causes it to become sufficiently conductive as to allow current flow therethrough, the degree of conductivity dependant upon the applied pressure, which is controllable by the human user via varying depressive pressure on actuator 18. Upon sufficient release of depressive pressure on actuator 18, dome-cap 16 returns under its own resilience to a normally raised position, the returning of dome-cap 16 relieving compressive pressure on pressure-sensitive variable-conductance material 30 to such a degree as to open the circuit, and desirably also raising or pushing actuator 18 to a normal resting position. When snap-through dome-cap 16 returns, it passes through it's snap-through threshold causing a tactile feedback or sensation detectable by the human user.

FIG. 7 shows a median cross section view of a flat mount sensor package in accordance with another embodiment of the present invention and showing pressure-sensitive variable-conductance material within a well 32 contacting second conductive element 14 and capped by a conductive cap 34. The FIG. 7 embodiment is the same as the FIG. 6 embodiment with the exception of the added conductive plate 34, which as described above can be defined as a lamination of pressure-sensitive variable-conductance material 30 onto conductive sheet material and then cut-out with a hole punch. Conductive plate 34 being atop pressure-sensitive variable-conductance material 30 is effectively closing pressure-sensitive variable-conductance material 30 within well 32. Conductive plate 34 should either be flexible so as to be able to bow into pressure-sensitive variable-conductance material 30, or loose fit in well 32 so as to be able to move in it's entirety into pressure-sensitive variable-conductance material 30 when pressure is applied thereto by snap-through dome-cap 16.

Figure 8:
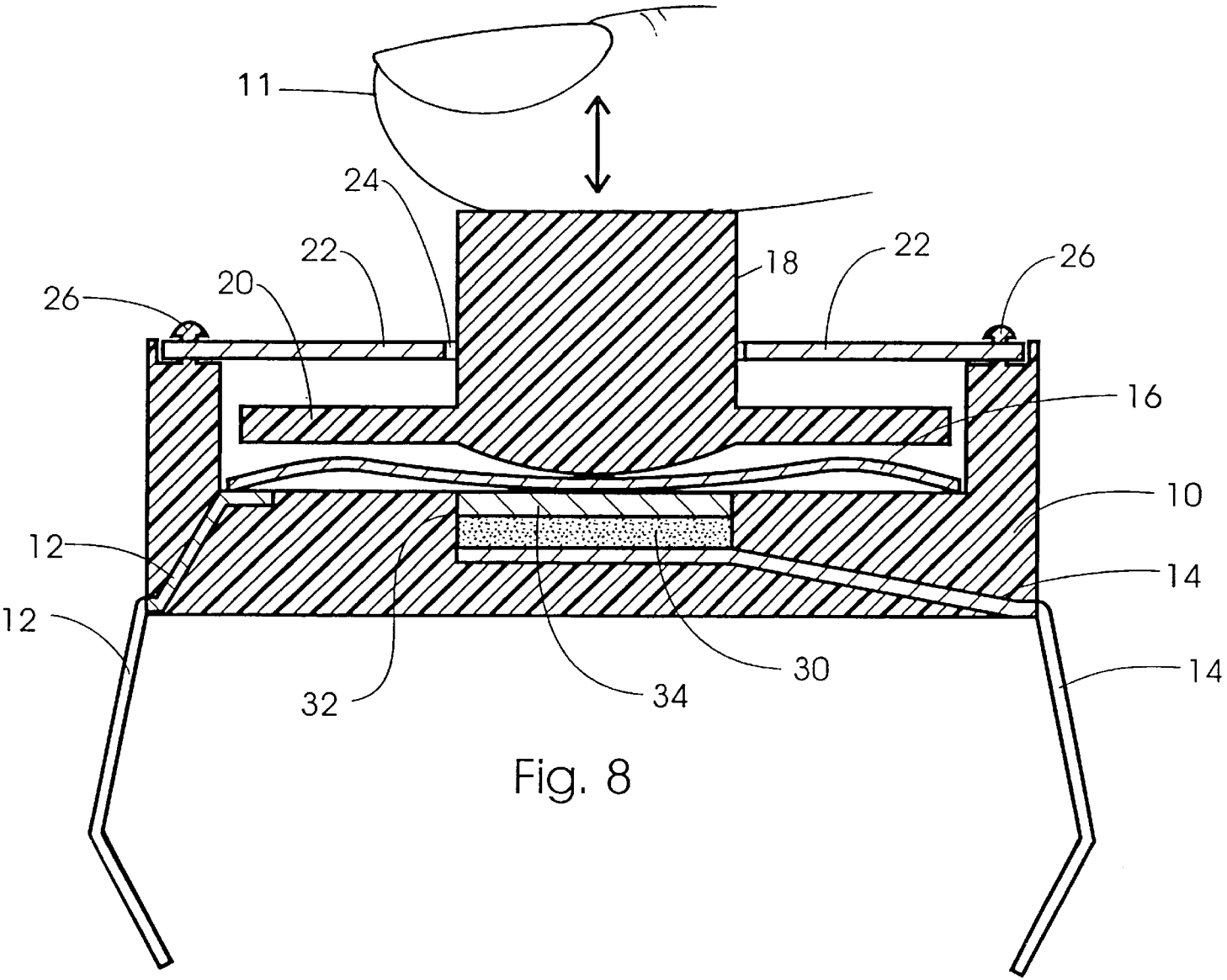
FIG. 8 shows a median cross section view of the embodiment of FIG. 7 in a depressed or actuated condition.

FIG. 8 shows a median cross section view of the embodiment of FIG. 7 with actuator 18 depressed, such as it would be by a user's single finger 11 or thumb 11, to such as degree as to cause dome-cap 16 to impinge upon conductive cap 34 atop the pressure-sensitive variable-conductance material 30. The pressure applied to conductive cap 34 is transferred in pressure-sensitive variable-conductance material 30. FIG. 8 illustrates the common aspect of the actuator 18 depressing both dome-cap 16 and pressure-sensitive variable-conductance material 30 as would be common to all of the embodiments herein shown and described in accordance with the present invention, additionally, the arrangement of dome-cap 16 between actuator 18 and pressure-sensitive variable-conductance material 30 may be reversed, i.e., pressure-sensitive variable-conductance material 30 positioned atop dome-cap 16 with one of the conductive elements 12 or 14 moved atop pressure-sensitive variable-conductance material 30, or actuator 18 may be an electrically conductive element of the embodiment.

Figure 9:
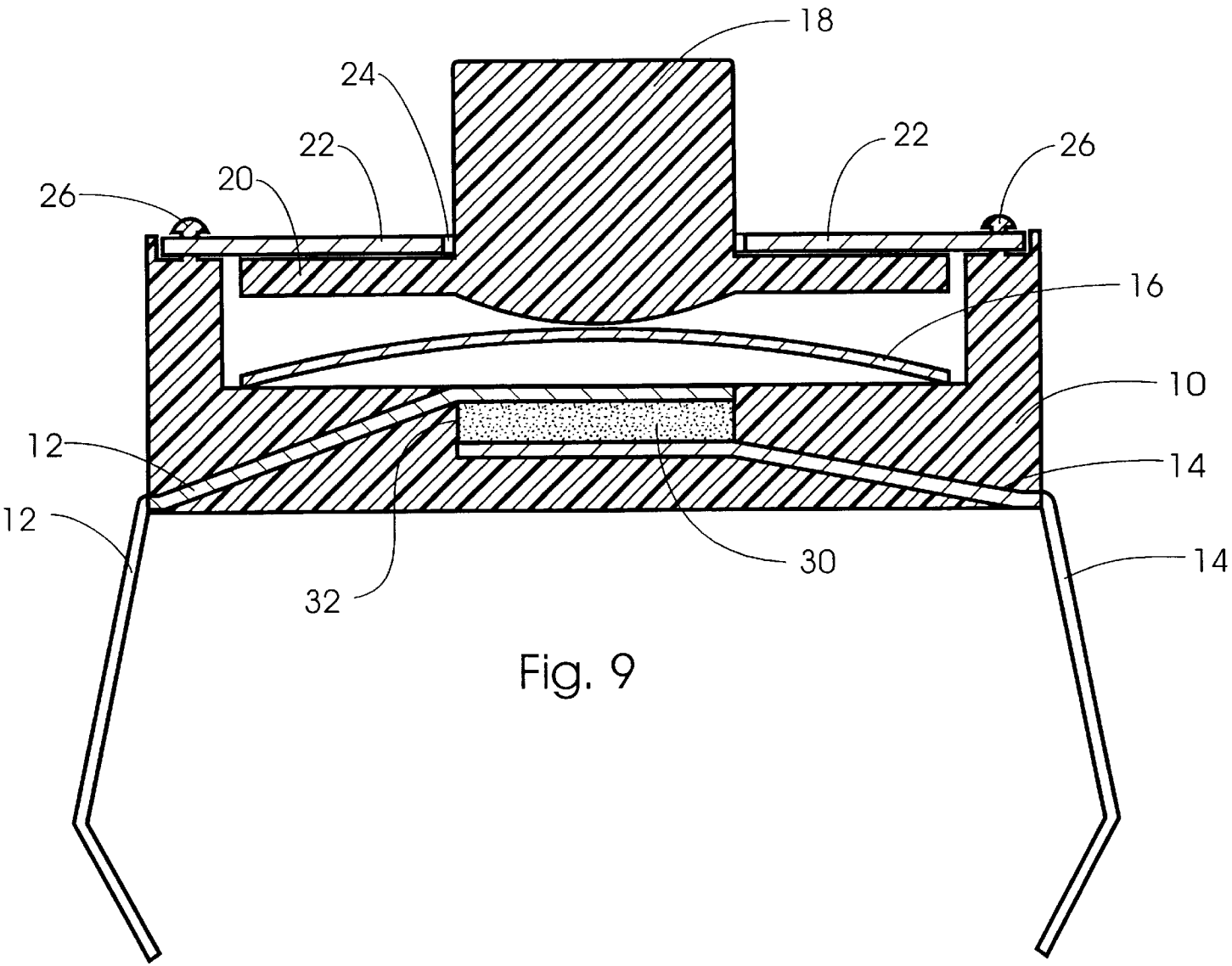
FIG. 9 shows a median cross section view of a flat mount sensor package in accordance with another embodiment of the present invention.

FIG. 9 shows a median cross section view of a sensor in accordance with the present invention wherein pressure-sensitive variable-conductance material 30 is within a well 32 and sandwiched between first conductive element 12, which has been extended from that shown in FIG. 8 to reach the center of the housing 10, and second conductive element 14. This sensor embodiment of the present invention demonstrates that snap-through dome-cap 16 need not always be electrically conductive. Dome-cap 16 may be conductive plastics or metal, but is not required to be in this embodiment, as first conductive element 12 has been extended to lay over and in spaced relationship to second conductive element 14. Pressure-sensitive variable-conductance material 30 is located between the two conductive elements 12, 14. Pressure applied to actuator 18 onto dome-cap 16 moves dome-cap 16 through its snap-through threshold causing a tactile feedback to the human user. Dome-cap 16 then continues toward the central portion of first conductive element 12, engages the element 12, applies force thereto and the force is transferred into pressure-sensitive variable-conductance material 30 via a degree of flexibility in first conductive element 12. Compressive force against pressure-sensitive variable-conductance material 30 causes it to become sufficiently conductive as to allow current flow therethrough, the degree of conductivity dependant upon the applied pressure or force, which is controllable by the human user via varying depressive pressure on actuator 18. Upon sufficient release of depressive pressure on actuator 18, dome-cap 16 returns under its own resilience to a normally raised position, the returning of dome-cap 16 relieving pressure on conductive element 12 and pressure-sensitive variable-conductance material 30 to such a degree as to open the circuit, and desirably also raising or pushing actuator 18 to a normal resting position. When snap-through dome-cap 16 returns, it passes through it's snap-through threshold causing a tactile feedback or sensation detectable by the human user, thereby the human user is alerted to the fact that the sensor has been de-actuated or in effect has been rendered electrically open.

Figure 10:
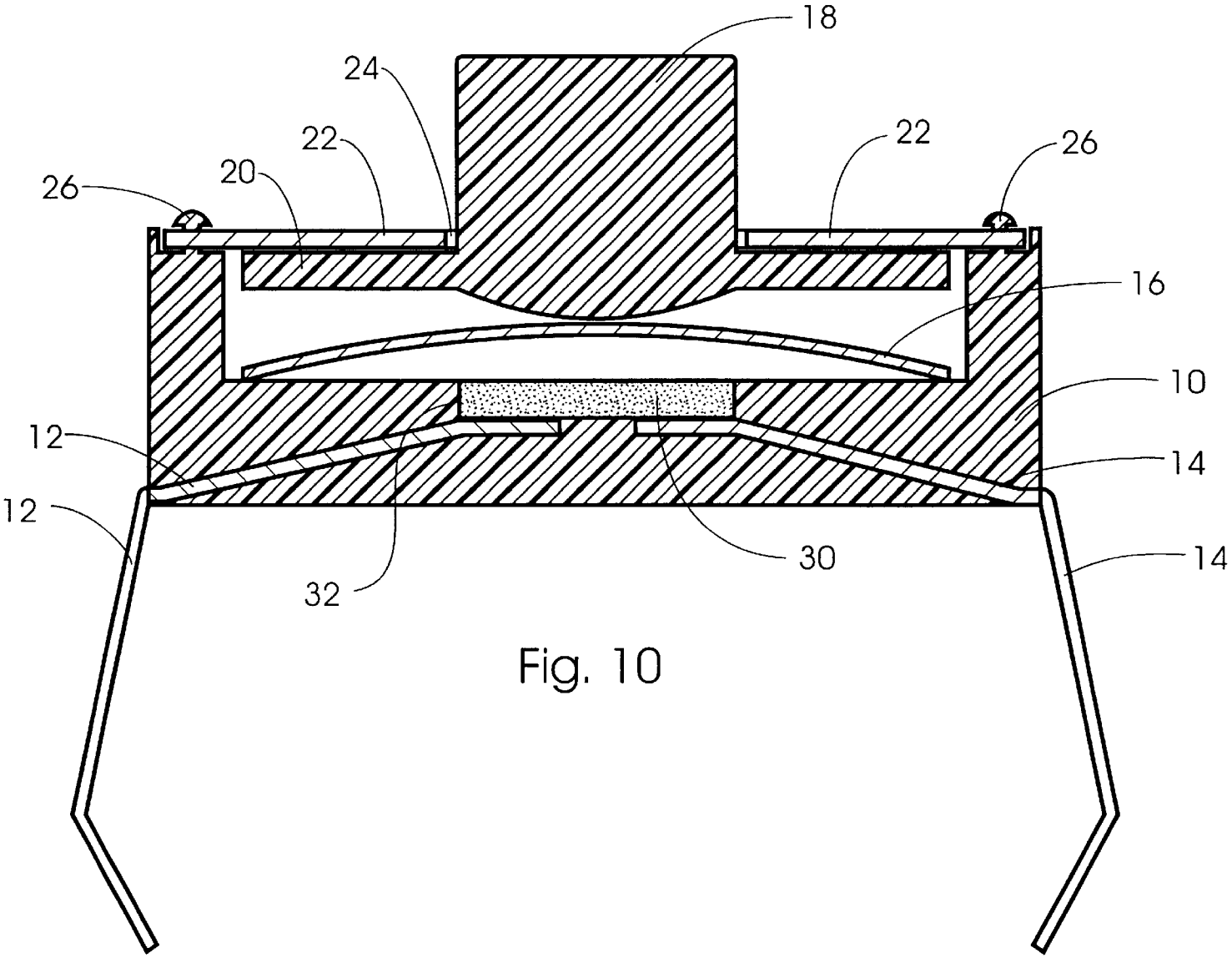
FIG. 10 shows a median cross section view of a flat mount sensor package in accordance with another embodiment of the present invention.

FIG. 10 shows a median cross section view of a sensor in accordance with another embodiment of the present invention wherein first and second conductive elements 12, 14 are shown proximal to one another within a well 32 in housing 10 and about the same elevation as one another. Pressure-sensitive variable-conductance material 30 is shown within well 32 and contacting each of conductive elements 12, 14 and spanning therebetween beneath snap-through dome-cap 16. Dome-cap 16 in this embodiment is not required to be electrically conductive. Pressure applied to actuator 18 onto dome-cap 16 moves dome-cap 16 through its snap-through threshold causing a tactile feedback. Dome-cap 16 then continues toward and basically instantaneously engages variable-conductance material 30. Compressive force against pressure-sensitive variable-conductance material 30 causes it to alter it's conductivity to become sufficiently conductive as to allow current flow therethrough and thus between conductive elements 12 and 14, the degree of conductivity or alteration of conductivity dependant upon the applied pressure, which is controllable by the human user via varying depressive pressure on actuator 18. Upon sufficient release of depressive pressure on actuator 18, dome-cap 16 returns under its own resilience to a normally raised position, the returning of dome-cap 16 relieving compressive pressure on pressure-sensitive variable-conductance material 30 to such a degree as to open the circuit, and desirably also raising or pushing actuator 18 to a normal resting position. When snap-through dome-cap 16 returns, it passes through it's snap-through threshold causing a tactile feedback or sensation detectable by the human user.

FIG. 11 shows a median cross section view of a sensor in accordance with another embodiment of the present invention wherein first and second conductive elements 12, 14 are shown proximal to one another within a well 32 in housing 10, and pressure-sensitive variable-conductance material 30 contacting each of the conductive elements 12, 14 and spanning therebetween, with the addition of a conductive cap 34 atop pressure-sensitive variable-conductance material 30 beneath snap-through dome-cap 16.

Figure 12:
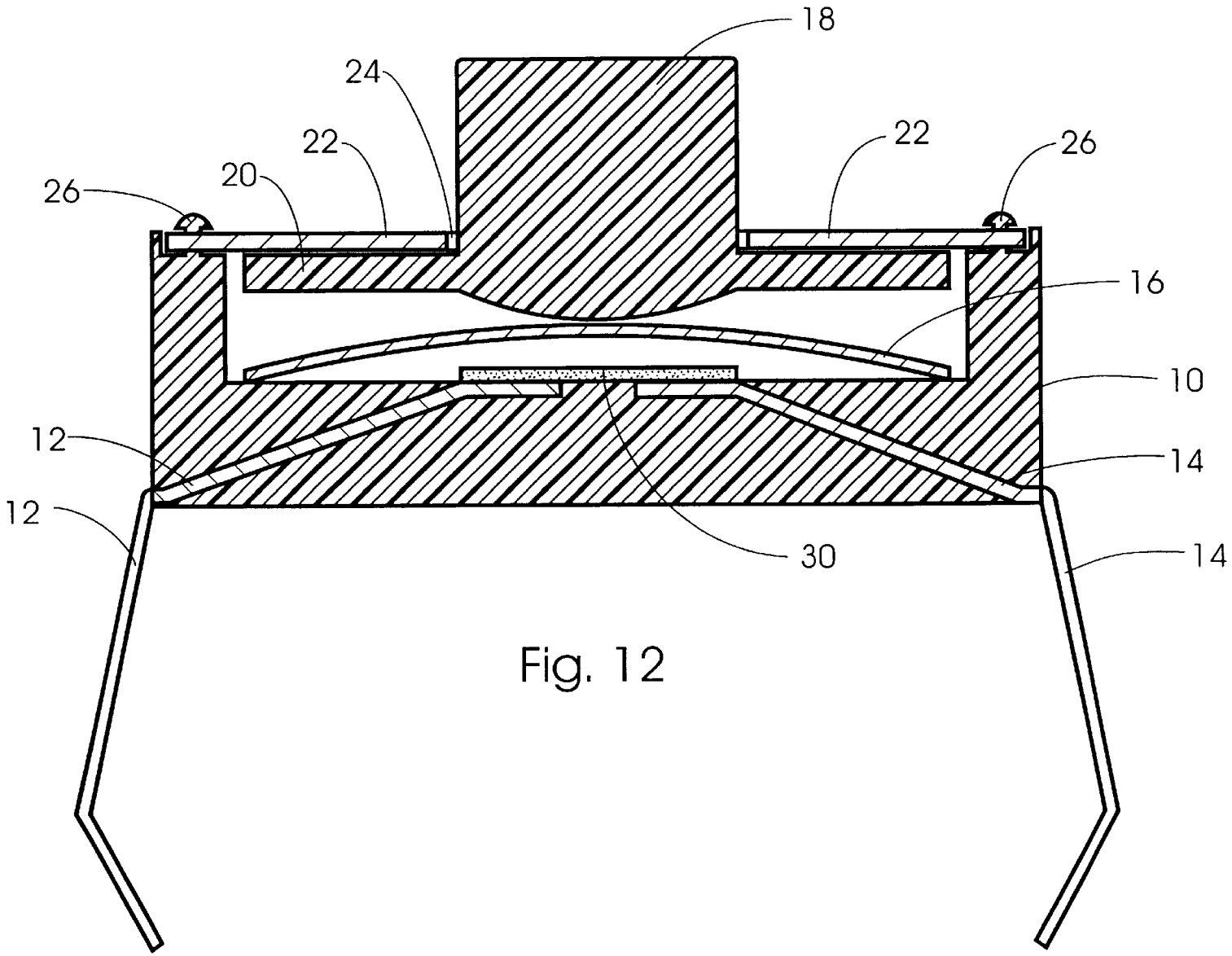
FIG. 12 shows a median cross section view of a flat mount sensor package in accordance with another embodiment of the present invention.

FIG. 12 shows a median cross section view of a sensor in accordance with another embodiment of the present invention which is basically the same as the FIG. 10 embodiment only sans well 32.

Figure 13:
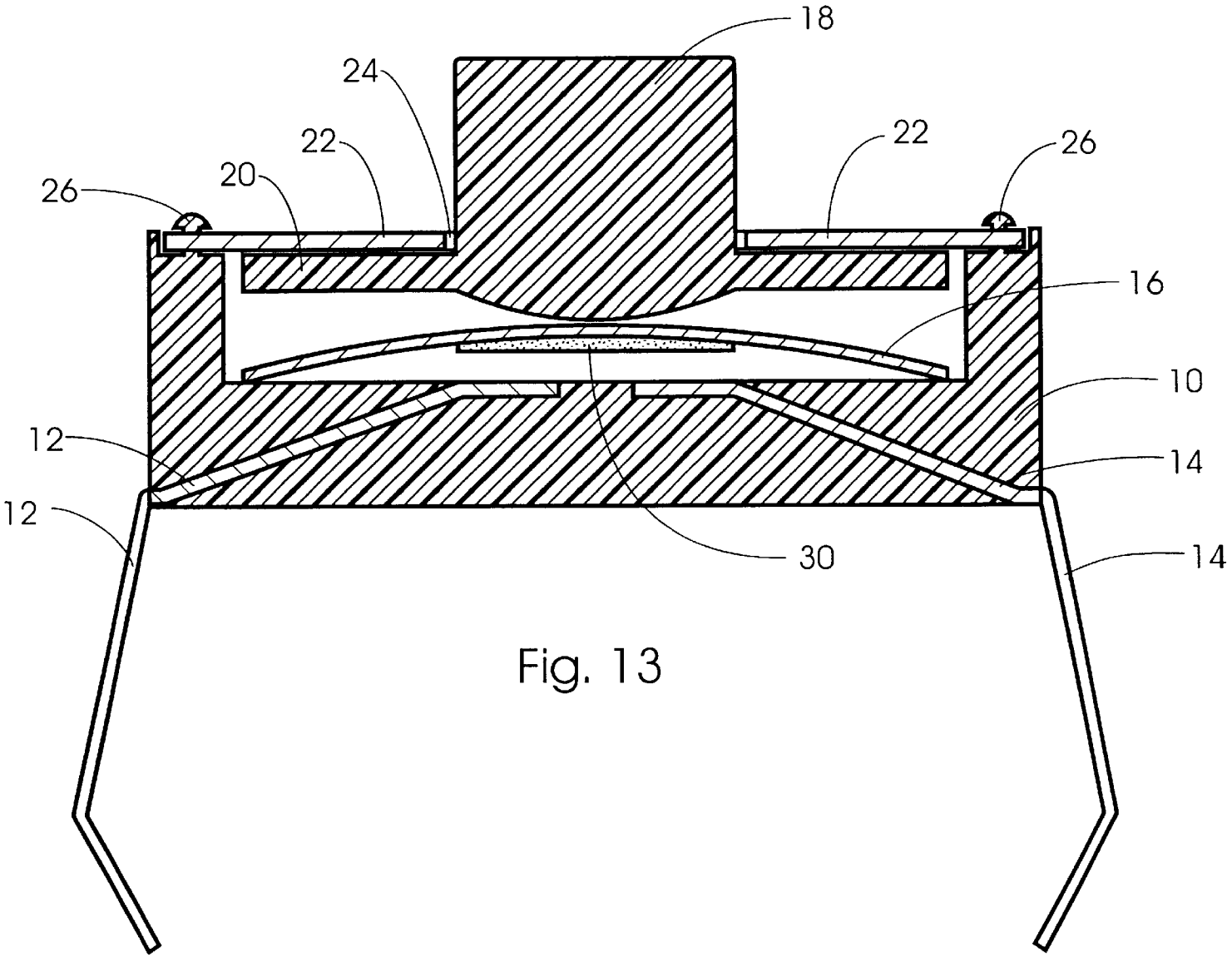
FIG. 13 shows a median cross section view of a flat mount sensor package in accordance with another embodiment of the present invention.

FIG. 13 shows a median cross section view of a sensor in accordance with another embodiment of the present invention which is basically the same as the FIG. 11 embodiment only with the pressure-sensitive variable-conductance material 30 adhered to the underside of snap-through dome-cap 16.

Figure 14:
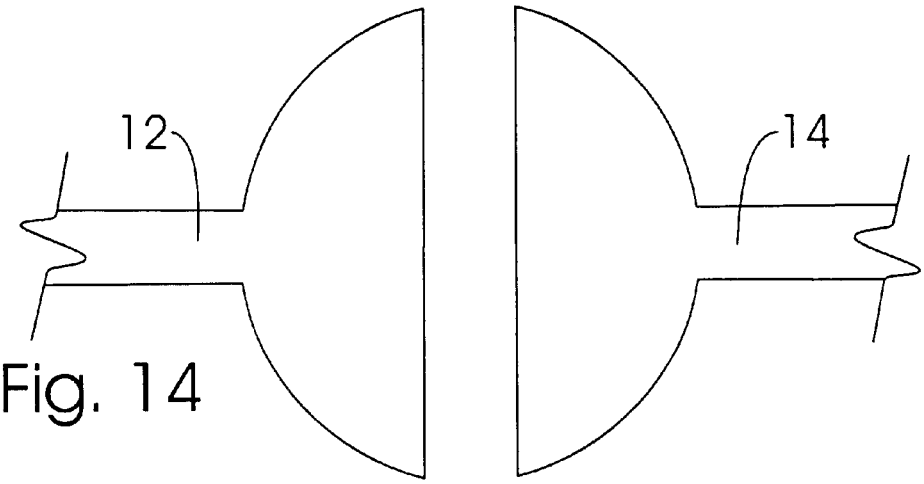
FIGS. 14–16 each show a top view of varied two conductive element arrangements.
Figure 15:
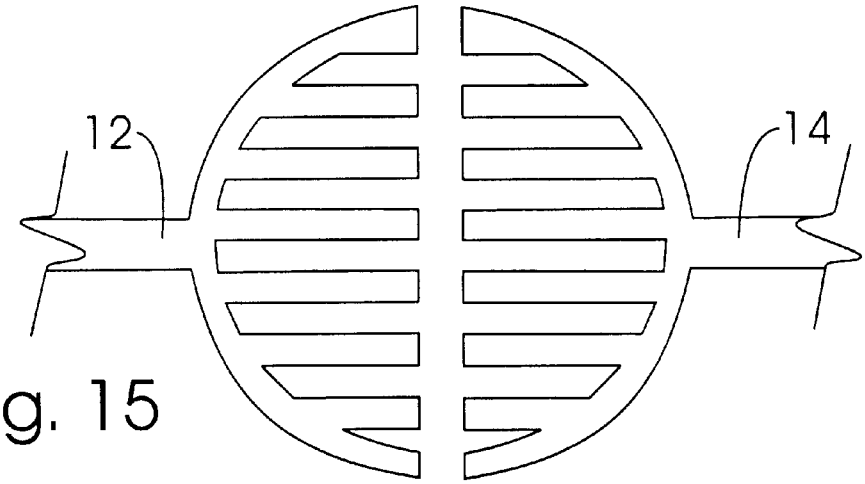
Figure 16:
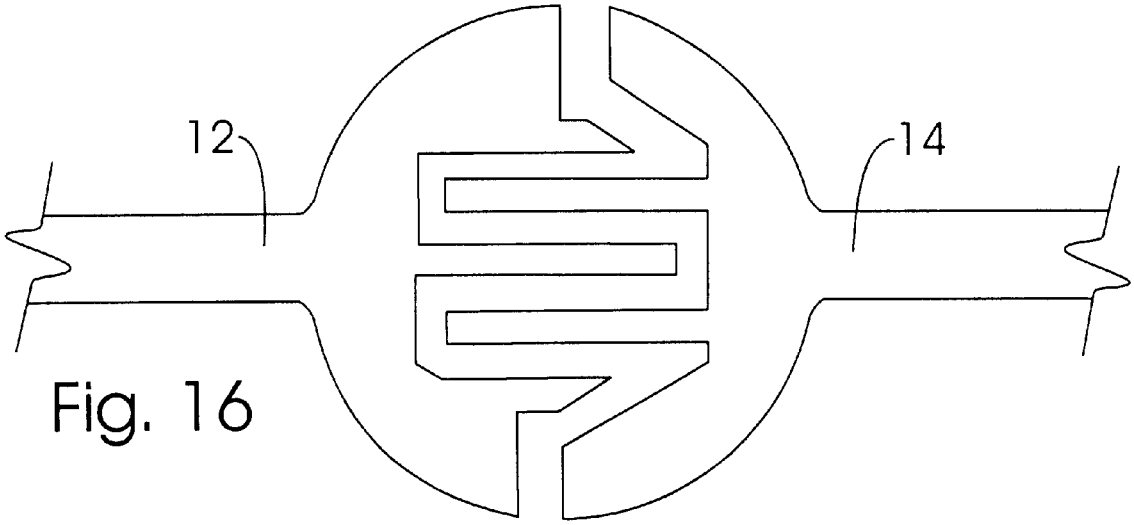

FIGS. 14–16 show a top view of two conductive elements 12, 14 in various proximal arrangements as they may be applied in the embodiments of FIGS. 10–13 within housing 10. FIG. 14 shows two conductive elements 12, 14 as two side-by-side plate-like pads. FIG. 15 shows two conductive elements 12, 14 as two side-by-side pads having opposed fingers. FIG. 16 shows two conductive elements 12, 14 as two side-by-side pads defined by interdigitated fingers.

The steps involved in manufacturing prior art momentary-on switches of the on/off type and including snap-through dome-caps 16 are well known, and although lacking the step of installing pressure-sensitive variable-conductance material positioned electrically for defining a variable conductive flow path through which electricity must move to complete a path between conductive elements 12, 14, the known methodology and manufacturing steps of the prior are applicable to the present invention. In reference to the present invention, the novel manufacturing step of installing pressure-sensitive variable-conductance material 30, includes the proper locating of material 30 positioned for serving as a flow path for electricity to flow between the two conductive elements 12, 14, wherein in some embodiments tactile feedback dome-cap 16 is electrically conductive and in other embodiments the dome-cap 16 is not required to be conductive. Such installation and positioning must be such that depressible actuator 18 and pressure-sensitive variable-conductance material 30 are in positional relationship to allow transference of externally applied force onto depressible actuator 18 through dome-cap 16 and onto pressure-sensitive variable-conductance material 30.

It should be understood, as those skilled in the art will recognize, that in some instances various features of one sensor embodiment can be mixed and matched with other features of the different sensor embodiments of the present invention to define hybrid embodiments which are not herein shown and described but which are well within the scope of the present invention.

Although I have very specifically described the preferred structures and best modes of the invention, it should be understood that the specific details are given for example to those skilled in the art. Changes in the specific structures described and shown may clearly be made without departing from the scope of the invention, and therefore it should be understood that the scope of the invention is not to be overly limited by the specification and drawings given for example, but is to be determined by the broadest possible and reasonable interpretation of the appended claims.

I claim:

1. A pressure-sensitive variable-conductance analog sensor with tactile feedback actuatable by a single human finger, comprising;

a housing;

electrically highly conductive elements at least in-part within said housing;

a depressible actuator retained by said housing and in-part exposed external to said housing for depression by a single human finger;

a resilient snap-through dome-cap positioned within said housing and depressible with force from said actuator applied to said dome-cap to cause said dome-cap to snap-through and create a snap-through tactile feedback detectable by the finger depressing the actuator; and pressure-sensitive variable-conductance material positioned within said housing, said pressure-sensitive variable-conductance material electrically positioned as a variably conductive element between said highly conductive elements, said pressure-sensitive variable-conductance material further positioned for receiving force applied to said dome-cap.

2. A pressure-sensitive variable-conductance analog sensor with tactile feedback in accordance with claim 1 wherein said pressure-sensitive variable-conductance material is variable in terms of electrical resistivity, the electrical resistivity lowering with increasing force applied to said depressible actuator.

3. A pressure-sensitive variable-conductance analog sensor with tactile feedback in accordance with claim 2 wherein said housing is formed of plastic and said dome-cap is metallic.

4. An improved analog sensor actuated by a single human finger, the sensor providing a variable output used for controlling an electronic game;

wherein the improvement comprises:

snap-through structuring for providing a snap-through tactile feedback to the finger.

5. An improved analog sensor in accordance with claim 4 wherein said analog sensor is a pressure-sensitive analog sensor and said single human finger is a single human thumb.

6. An improved analog sensor in accordance with claim 5 wherein said snap-through structuring includes a metallic dome-cap.

7. An improved momentary-On snap-through switch of the type having a housing; a resilient snap-through tactile feedback dome-cap positioned within said housing; a depressible actuator retained by said housing and in-part exposed external to said housing for being depressed by a single human finger;

wherein the improvement comprises:

analog structuring within said housing for creating a variable electrical output representational of variable depression of said actuator.

8. An improved momentary-on snap-through switch in accordance with claim 7 wherein said electrical output is variable in terms of electrical resistivity, the electrical resistivity lowering with increasing depression of said actuator.

9. An improved analog sensor of the type having at least two highly conductive electrical elements operationally connected to pressure-sensitive analog structure; a depressible actuator in-part exposed to be depressible toward said pressure-sensitive analog structure for supplying an analog electrical output according to depression of said actuator;

wherein the improvement comprises:

a resilient snap-through dome-cap positioned to provide tactile feedback through said actuator to a human user's thumb depressing said actuator.

10. An improved analog sensor in accordance with claim 9 wherein said snap-through dome-cap is metallic.

11. An improved pressure-sensitive analog sensor providing an electrically varying output, said varying output used for controlling an electronic game, the varying output representational of varying depressive input by a single human thumb, wherein the improvement comprises:

a depressible resilient snap-through tactile element, upon depression said tactile element creates a tactile feedback detectable by the single thumb.

12. An improved pressure-sensitive analog sensor according to claim 11 wherein said snap-through tactile element is metallic.

13. An analog sensor, comprising;

means for varying electrical resistance for providing a varying output representational of varying depressive input by a single human finger; and a depressible resilient snap-through tactile element, when depressed said tactile element creating a tactile feedback detectable by the single finger.

14. An analog sensor according to claim 13 wherein said analog sensor is a pressure-sensitive analog sensor.

15. An analog sensor according to claim 14 further including an actuator positioned between the single human finger and said tactile element, and said tactile element is a dome-cap.

16. An analog sensor according to claim 15 wherein said dome-cap is metallic.

17. An analog sensor, comprising:

an actuator moveable by only a single human finger; responsive to movement of said actuator is first means for varying electrical resistance and providing a varying electrical output of said sensor; and responsive to movement of said actuator is second means for providing a snap-through threshold tactile feedback detectable upon deactivation of said first means, said snap-through tactile feedback detectable by the single human finger.

18. An analog sensor according to claim 17 wherein said second means comprises a dome-cap structure, and another snap-through threshold tactile feedback is discernable upon activation of said first means.

19. An analog sensor according to claim 18 wherein said dome-cap is metallic.

20. An improved analog sensor of a type actuated by a single human finger, the sensor providing an analog variable electrical output used for controlling an electronic game;

wherein the improvement comprises:

means for providing a user discernable snap-through threshold tactile feedback to the finger, said user discernable snap-through threshold tactile feedback is provided on deactuation of the variable electrical output used for controlling the electronic game.

21. An improved analog sensor in accordance with claim 20 wherein another user discernable snap-through threshold tactile feedback is provided on actuation of the variable electrical output used for controlling the electronic game.

22. An improved analog sensor in accordance with claim 21 wherein said means includes a metallic dome-cap.

23. An improved analog sensor in accordance with claim 21 wherein said analog sensor is a pressure-sensitive analog sensor, and the single human finger is a single human thumb.

24. An improved analog sensor in accordance with claim 23 wherein said means includes a non-metallic dome-cap.

* * * * *

UNITED STATES PATENT AND TRADEMARK OFFICE

CERTIFICATE OF CORRECTION

PATENT NO. : 6,563,415 B2
DATED : May 13, 2003
INVENTOR(S) : Brad A. Armstrong

It is certified that error appears in the above-identified patent and that said Letters Patent is hereby corrected as shown below:

Title page,
Item [60], Related U.S. Application Data, the data should read:
-- Division of application No. 09/455,821, filed on Dec. 6, 1999 which is a continuation of application 09/106,825 filed Jun. 29, 1998, now Pat. No. 5,999,084, and a continuation-in-part of application No. 08/677,378, filed on Jul. 5, 1996, now Pat. No. 6,222,525. --

Column 1,
Line 4, under heading "CROSS-REFERENCE TO RELATED APPLICATION(S)", the wording in that section should read:
-- This Application is a divisional of U.S. Patent Application No. 09/455,821 filed Dec. 6, 1999 and which the specification is herein incorporated by reference. Application No. 09/455,821 is a continuation of U.S. Patent Application No. 09/106,825 filed on Jun. 29, 1998, now U.S. Patent 5,999,084, the entire contents of which are hereby incorporated by reference. This Application is also a continuation-in-part of U.S. Patent Application 08/677,378 filed July 5, 1996, now U.S. Patent 6,222,525. --

Signed and Sealed this

Second Day of August, 2005

JON W. DUDAS
*Director of the United States Patent and Trademark Office*

US006563415C1

(12) INTER PARTES REEXAMINATION CERTIFICATE (0315th)

United States Patent
Armstrong

(10) Number: US 6,563,415 C1
(45) **Certificate Issued: *Nov. 15, 2011**

(54) ANALOG SENSOR(S) WITH SNAP-THROUGH TACTILE FEEDBACK

(75) Inventor: Brad A. Armstrong, Carson City, NV (US)

(73) Assignee: Anascape, Ltd., Tyler, TX (US)

Reexamination Request:
No. 95/000,230, Apr. 19, 2007
No. 95/000,224, May 10, 2007

Reexamination Certificate for:

| | |
|---|---|
| Patent No.: | **6,563,415** |
| Issued: | **May 13, 2003** |
| Appl. No.: | **09/955,838** |
| Filed: | **Sep. 18, 2001** |

( * ) Notice: This patent is subject to a terminal disclaimer.

Certificate of Correction issued Aug. 2, 2005.

Related U.S. Application Data

(60) Division of application No. 09/455,821, filed on Dec. 6, 1999, now abandoned, which is a continuation of application No. 09/106,825, filed on Jun. 29, 1998, now Pat. No. 5,999,084, and a continuation-in-part of application No. 08/677,378, filed on Jul. 5, 1996, now Pat. No. 6,222,525.

(51) Int. Cl.

| | |
|---|---|
| ***H01H 13/26*** | (2006.01) |
| ***H01H 13/48*** | (2006.01) |
| ***H01C 10/00*** | (2006.01) |
| ***H01C 10/10*** | (2006.01) |

(52) U.S. Cl. ..... 338/47; 338/112; 338/114; 338/5; 338/99

(58) Field of Classification Search ..... None
See application file for complete search history.

(56) References Cited

To view the complete listing of prior art documents cited during the proceedings for Reexamination Control Numbers 95/000,224 and 95/000,230, please refer to the USPTO's public Patent Application Information Retrieval (PAIR) system under the Display References tab.

*Primary Examiner*—James Menefee

(57) ABSTRACT

An analog sensor depressible by a single human finger/thumb. Depressive force is applied to a dome-cap and to analog materials for varying an analog output of the sensor responsive to varying force applied by a single finger or thumb. Depressive force causes the dome-cap to bow downward passing through a user discernable threshold, causing a snap-through tactile sensation. In some embodiments the dome-cap is metallic.

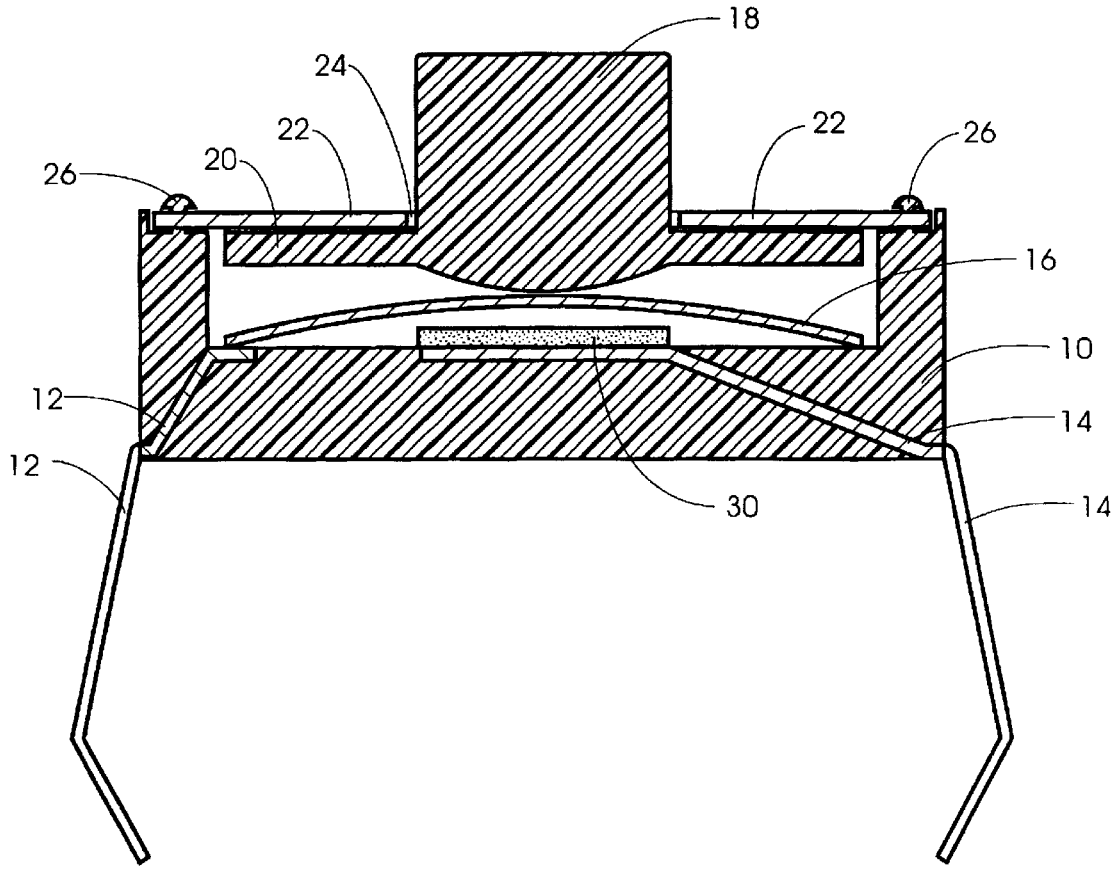

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-24 are cancelled.

* * * * *